US007437798B2

(12) United States Patent
Zhang

(10) Patent No.: US 7,437,798 B2
(45) Date of Patent: Oct. 21, 2008

(54) AIR REFLUX ASSEMBLY OF THE VACUUM CLEANER

(76) Inventor: Zhouxin Zhang, Room 303, Building 37, Hongqiao Sicun, Jiangyin, Jiangsu China 214431 (CN)

( * ) Notice: Subject to any disclaimer, the term of this patent is extended or adjusted under 35 U.S.C. 154(b) by 113 days.

(21) Appl. No.: 11/660,587

(22) PCT Filed: Aug. 23, 2004

(86) PCT No.: PCT/CN2004/000975

§ 371 (c)(1),
(2), (4) Date: Feb. 20, 2007

(87) PCT Pub. No.: WO2005/037046

PCT Pub. Date: Apr. 28, 2005

(65) Prior Publication Data

US 2008/0092328 A1 Apr. 24, 2008

(30) Foreign Application Priority Data

Aug. 21, 2003 (CN) ..... 03 1 32397

(51) Int. Cl.
*A47L 5/00* (2006.01)

(52) U.S. Cl. ..... 15/412; 15/352

(58) Field of Classification Search ..... 15/412, 15/347, 352; *A47I 5/00, 9/00*
See application file for complete search history.

(56) References Cited

U.S. PATENT DOCUMENTS 6,345,411 B1 * 2/2002 Kato et al. ..... 15/412
6,484,354 B2 * 11/2002 Lee ..... 15/346
6,684,451 B2 * 2/2004 Kato et al. ..... 15/319

FOREIGN PATENT DOCUMENTS

| | | |
|---|---|---|
| CN | 1562584 | 1/2005 |
| JP | 2001-161606 | 6/2001 |
| JP | 2001-169973 | 6/2001 |
| JP | 2001-340268 | 12/2001 |
| JP | 2002-165733 | 6/2002 |
| WO | WO 01/30228 | 5/2001 |
| WO | 2004/080664 | 9/2004 |

* cited by examiner

*Primary Examiner*—David A Redding
(74) *Attorney, Agent, or Firm*—Hudak, Shunk & Farine Co. LPA

(57) ABSTRACT

An air reflux assembly for a conventional or a automatic cleaner comprising an outer shell, an inner shell, a rotating disc, a rotating disc seat and plurality of return air ducts. The inner shell is positioned in the lower part of the inner chamber of the outer shell and does not contact the inner wall of the outer shell; the rotating disc seat is connected to the upper portion of the inner shell, the lower part of the rotating disc is placed in the rotating disc seat, three groups of windows are arranged in the upper, middle and lower portion of the rotating disc, another three groups of windows which correspond to the three groups of windows of the rotating disc are arranged in the upper, middle and lower portion of the rotating disc seat; air inlets and air outlets are arranged in the rotating disc seat and the two ends of the return air ducts are respectively connected to the air inlets and air outlets. The cleaner of the present invention is of high suction and easy to remove the trash collected by the cleaner.

15 Claims, 13 Drawing Sheets

AIR REFLUX ASSEMBLY OF THE VACUUM CLEANER

FIELD OF THE INVENTION

The present invention relates to an air reflux assembly for a cleaner which can be mainly applied to a future automatic cleaner or cleaning robot. It can also be applied to a conventional vacuum cleaner to improve the performance thereof.

BACKGROUND OF THE INVENTION

All the current vacuum cleaners adopt single "dust collection" via inducing air from the air inlet. The efficiency of the motor for dust collection is relatively low. Particularly, the power of the motor for a portable cleaner or a current or future automatic cleaner which is powered by batteries is commonly relatively low, the suction is thus relatively small and so affects the performance of the cleaner as a household appliance. Moreover, there exists an outstanding inconvenience when using the conventional vacuum cleaner, i.e., the cleaner must be disassembled to remove the trash contained therein. Such problem is particularly notable for an automatic cleaner having sensors and small trash chambers.

SUMMARY OF THE INVENTION

The purpose of the present invention is to overcome the disadvantages described as above and provide an air reflux assembly for a cleaner to obtain a high suction and make it easy to remove the trash collected in the cleaner.

The purpose of the present invention can be carried out by adopting the following technical solution. An air reflux assembly for a cleaner comprising an outer shell, an inner shell, a rotating disc, a rotating disc seat and return air ducts, the inner shell is positioned in the lower part of the inner chamber of the outer shell, the rotating disc seat is connected to the upper portion of the inner shell, the lower portion of the rotating disc is placed in the rotating disc seat, a first three groups of upper windows, middle windows and lower windows are arranged in the upper, middle and lower portions of the rotating disc, a second three groups of upper windows, middle windows and lower windows which correspond to the three groups of windows of the rotating disc are arranged in the upper, middle and lower portions of the rotating disc seat; plurality of air inlets and air outlets are respectively arranged in the upper portion and lower portion of the rotating disc seat and the two ends of the return air ducts are respectively connected to the air inlets and air outlets.

When the upper windows of the rotating disc are rotated to the positions where said upper windows are aligned with the upper windows of the rotating disc seat, the air inlets of the rotating disc seat are covered by other portions of the rotating disc other than the upper windows thereof, the middle windows of the rotating disc are covered by other portions of the rotating disc seat other than the middle windows thereof, the middle windows of the rotating disc seat are covered by other portions of the rotating disc other than the middle windows thereof, the lower windows of the rotating disc are aligned with the lower windows of the rotating disc seat and thereby the air can be induced into the trash chamber from the air inlet of the cleaner through the air inlet tunnel, the trash is left in the trash chamber but the air goes through the filter into the lower chamber. The air enters the upper chamber through the lower windows of the rotating disc seat and the lower windows of the rotating disc and is then forced into the motor chamber by an impeller or a fan. Next, the air goes through the change tunnel, the upper windows of the rotating disc and the upper windows of the rotating disc seat and enters the middle chamber. Then the air is discharged from the air outlets of the cleaner through the tunnel which is formed between the inner wall of the outer shell and the outer wall of the inner shell. This is the mode for collecting trash.

When the upper windows of the rotating disc are rotated to the positions where said upper windows are aligned with the upper air inlets of the rotating disc seat, the upper windows of the rotating disc seat are covered by other portions of the rotating disc other than the upper windows thereof, the middle windows of the rotating disc are aligned with the middle windows of the rotating disc seat, the lower windows of the rotating disc are covered by other portions of the rotating disc seat other the lower windows thereof, the lower windows of the rotating disc seat are covered by other portions of the rotating disc other than the lower windows thereof and thereby the air is induced into the middle chamber from the air outlet of the cleaner through the tunnel which is formed between the inner wall of the outer shell and outer wall of the inner shell, enters the upper chamber through the middle windows of the rotating disc seat and the middle windows of the rotating disc, then is forced into the motor chamber by the impeller or the fan, enters the return air path through the change tunnel, the upper windows of the rotating disc and the air inlets of the rotating disc seat; next, the air goes into the lower chamber through the air outlet of the rotating disc seat and enters the trash chamber through the filter, then takes the trash and goes through the air inlet tunnel and finally the trash is blown out of the cleaner. This is the mode for blowing trash.

The air reflux assembly of this invention can be applied to change the air flow path in a conventional vacuum cleaner and raise its suction without necessarily increasing the input power of the motor. The trash collected by the cleaner can also be easily discharged by this invention. These advantages are particularly important to an automatic cleaner.

The air reflux assembly of the present invention can also direct the discharged, high velocity air to the area of the air inlet of the cleaner to raise the dust on the ground. The raised dust is then forced into the cleaner by the suction. By this way, the single "vacuum clean" is replaced by "vacuum clean" plus "blow clean" and thereby the efficiency of the cleaner is increased. When the trash needs to be discharged, the rotating disc, rotating disc seat and the return air duct can be applied to change the air flow path. The air goes through the return air duct and blows from the top of the filter to discharge the trash which is collected in the trash chamber.

DETAILED DESCRIPTION OF THE INVENTION

Figure 1:
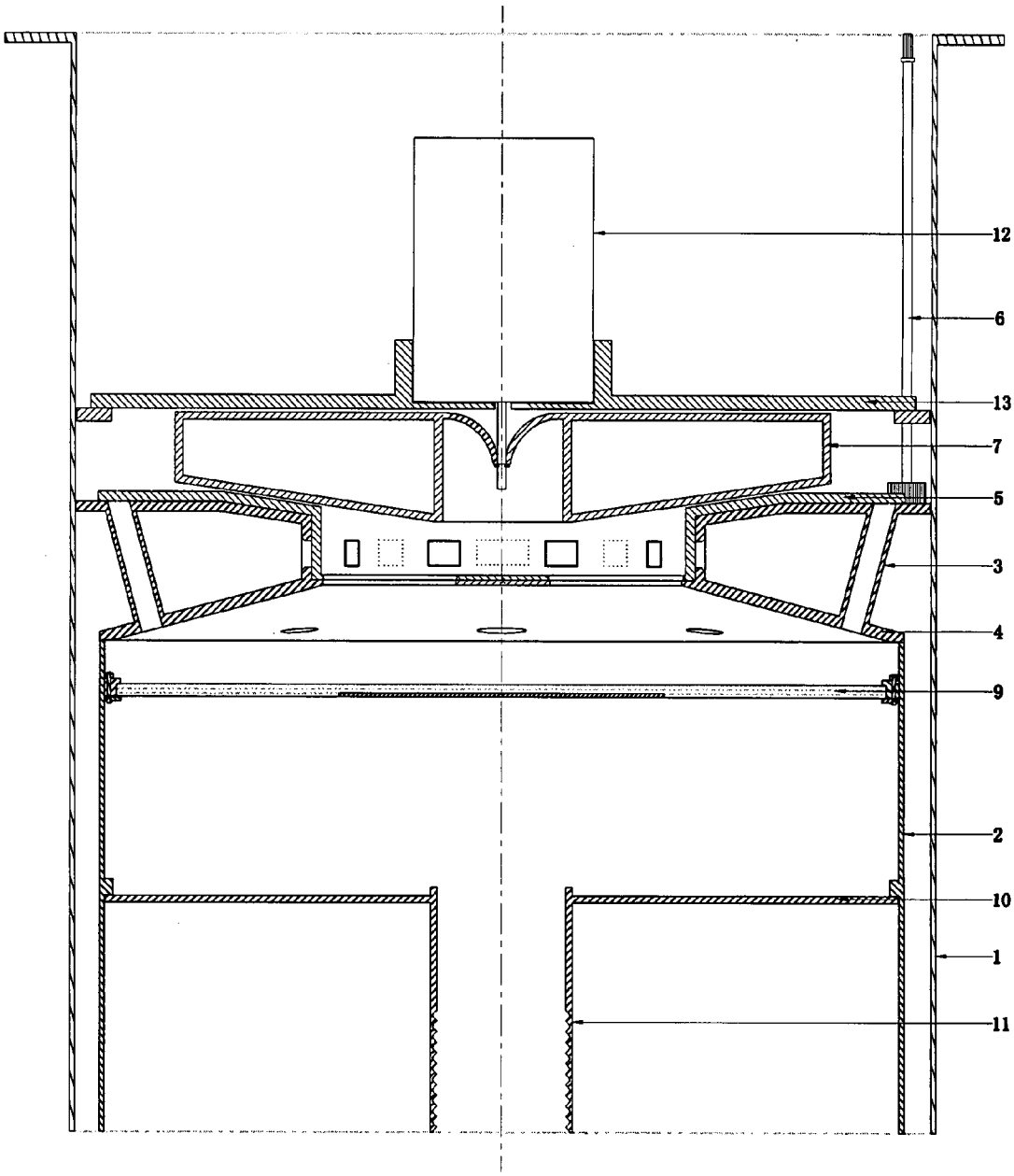
FIG. 1 is a schematic diagram of one structure of the present invention.
Figure 2:
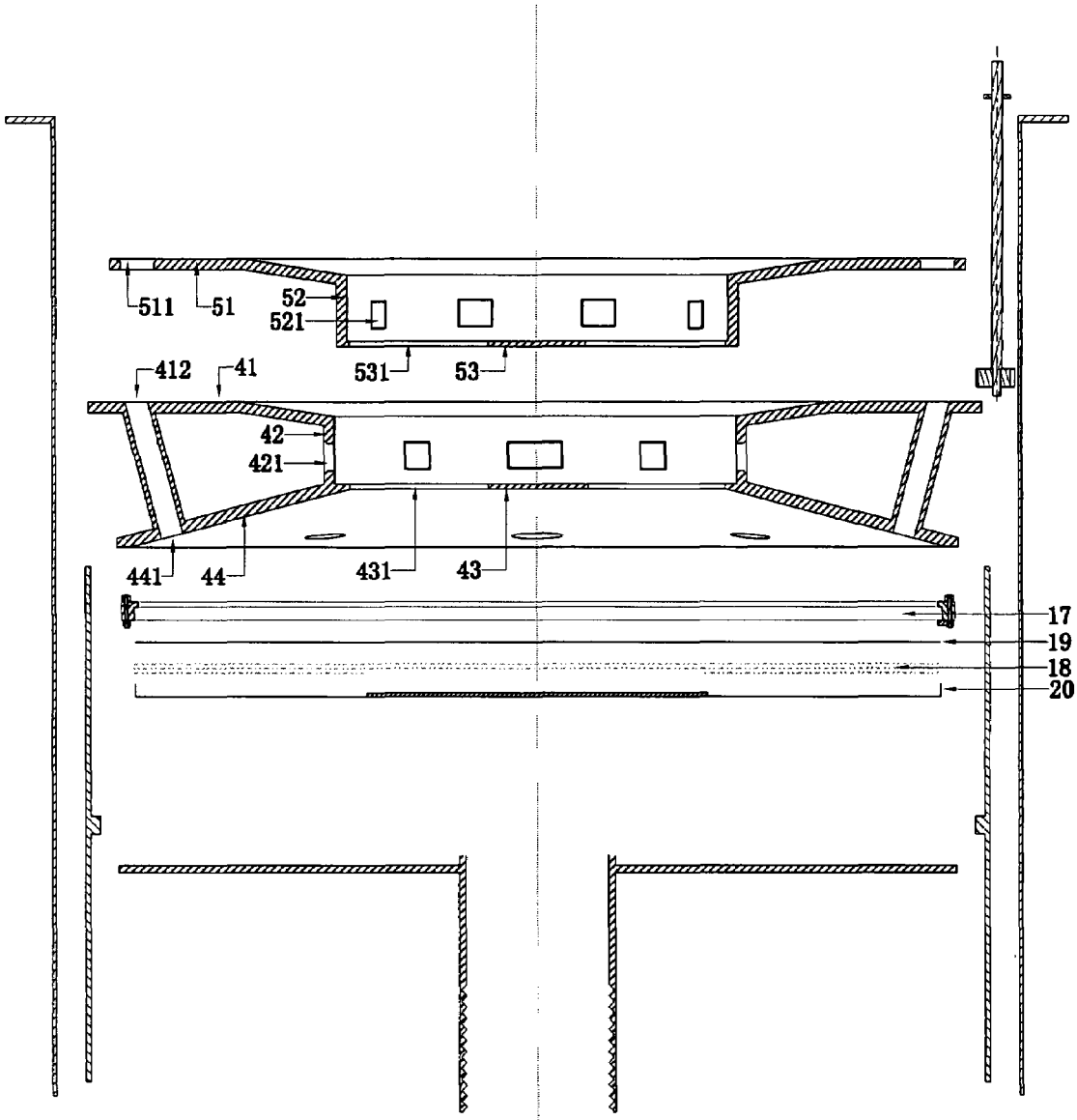
FIG. 2 is an exploded view of FIG. 1.
Figure 3:
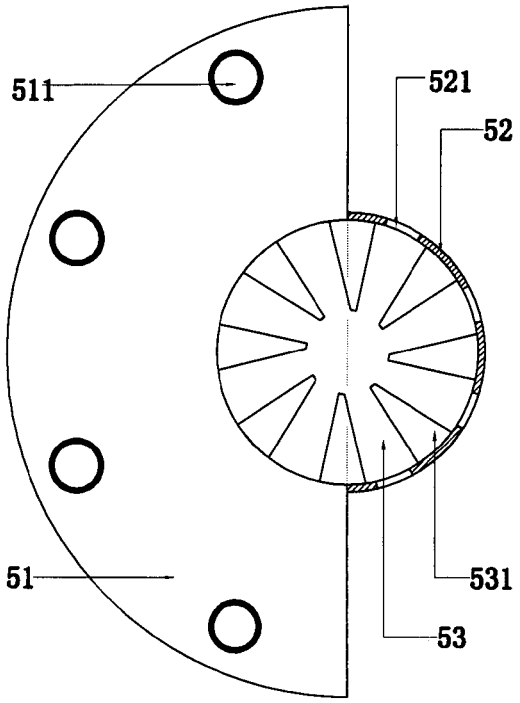
FIG. 3 is the top view of the half cross section of the rotating disc of the present invention.
Figure 4:
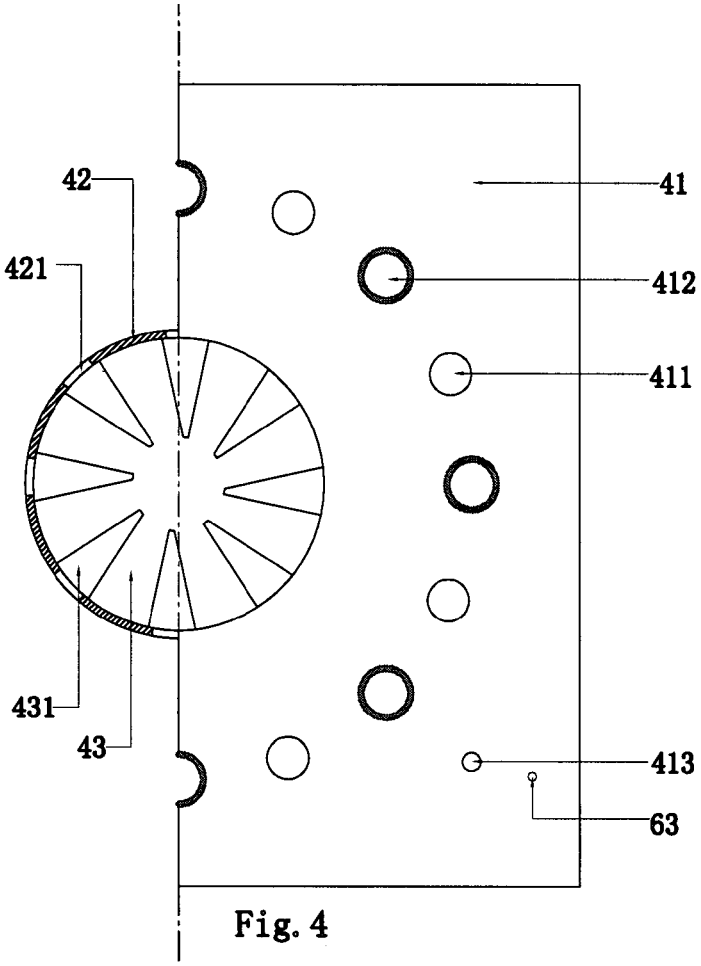
FIG. 4 is the top view of the half cross section of the rotating disc seat of the present invention.

As shown in FIG. 1, the air reflux assembly of the present invention is arranged between the impeller 7 and the trash filter 9 of a cleaner. The assembly mainly comprises an outer shell 1, an inner shell 2, a rotating disc 5, a rotating disc seat 4, return air ducts 3 and rotating disc driving unit 6. Inner shell 2 is positioned in the lower part of the inner chamber of the outer shell 1 and does not contact the inner wall of the outer shell 1; as shown in FIGS. 2-4, the rotating disc (5) is in a shape of an inverted cap and comprises an upper portion (51), a body (52) and a lower portion (53). The cross section of the rotating disc seat 4 is in an "H" shape; the rotating disc seat 4 comprises a body 42, upper and lower flange 41, 44 and partition 43. The partition 43 is placed across the inner chamber of the body 42. The outer edge of the lower flange 44 is connected to the upper portion of the inner wall of the inner shell 2; the outer edge of the upper flange 41 is connected to the middle portion of the inner wall of the outer shell 1; the rotating disc 5 is shaped as a "hat" or the like and the body 52 of it is inserted and positioned in the upper portion of the body 42 of the rotating disc seat 4 whereas the bottom side of the upper portion 51 of the rotating disc is just placed against the upper flange 41 of the rotating disc seat 4 and is positioned under impeller 7. The bottom portion 53 of the rotating disc 5 is just placed against partition 43 of the rotating disc seat 4, upper windows 511, middle windows 521 and lower windows 531 are formed respectively in the upper portion 51, the body 52 and the lower portion 53 of the rotating disc 5, and upper windows 411, middle windows 421 and lower windows 431 are formed respectively in upper flange 41, body 42 and partition 43 of the rotating disc seat which correspond to the upper windows 511, the middle windows 521 and the lower windows 531 of the rotating disc 5; plurality of upper air inlets 412 are formed in the upper flange 41 of the rotating disc seat 4 and plurality air outlets 441 are formed in the lower portion of the body 42 or the lower flange 44. The two ends of the return air ducts 3 are connected respectively to the air inlets 412 and the air outlets 441. Rotating disc 5 can be rotated by a rotating disc driving unit 6 to a certain range of degrees between rotating disc seat 4 and impeller 7. Filter support of trash filter 9 is fixed on the bottom side of the lower flange 44 of the rotating disc seat 4 or the inner wall of the inner shell 2.

Said rotating disc driving unit 6 can be manually operated or electrically operated.

Figure 5:
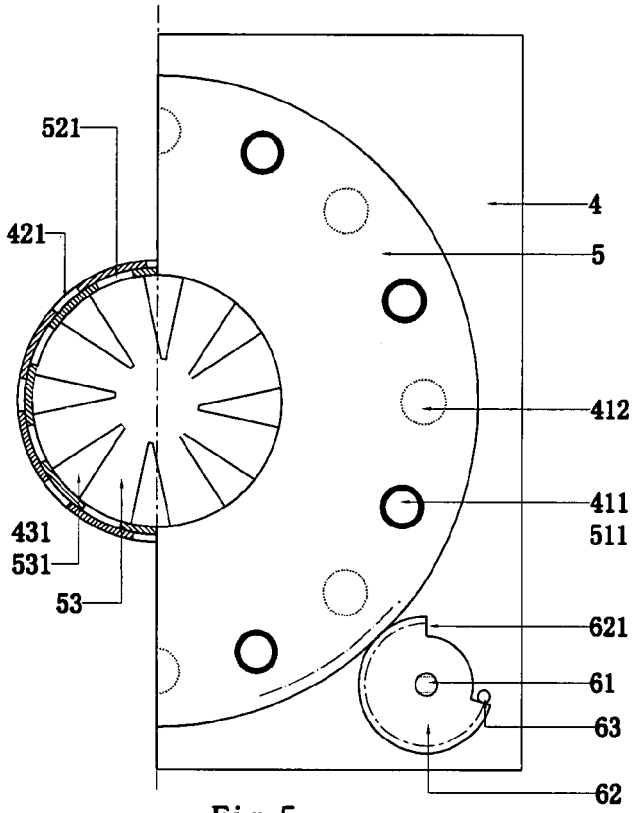
FIG. 5 is the top view of the half cross section of the rotating disc seat, rotating disc and the driving unit therefor in the mode of collecting trash.
Figure 6:
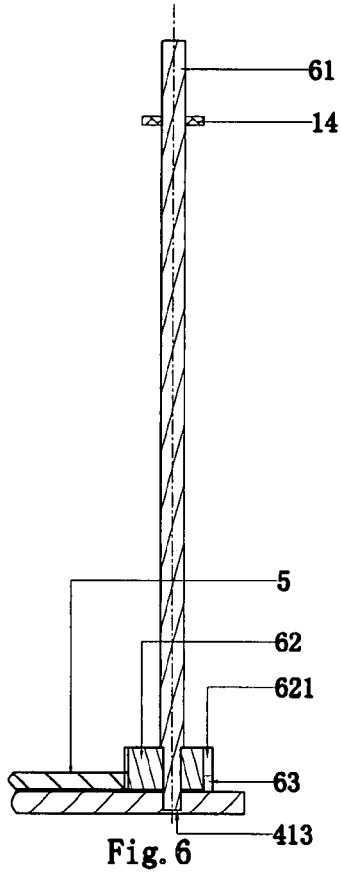
FIG. 6 is a schematic diagram of the structure of a manually rotated disc driving unit of the present invention.

As shown in FIG. 5 and FIG. 6, manually operated rotating disc driving unit 6 comprises a handle 61, a change gear 62 connected to the lower portion of the handle and engagement teeth which are arranged on part of the outer portion of the rotating disc 5. The lower portion of the handle 61 is inserted and positioned in the change shaft hole 413 of the rotating disc seat 4. A slot 621 is formed on the outer edge of change gear 62 and a lock pin 63 corresponding thereto is arranged on rotating disc seat 4.

Figure 7:
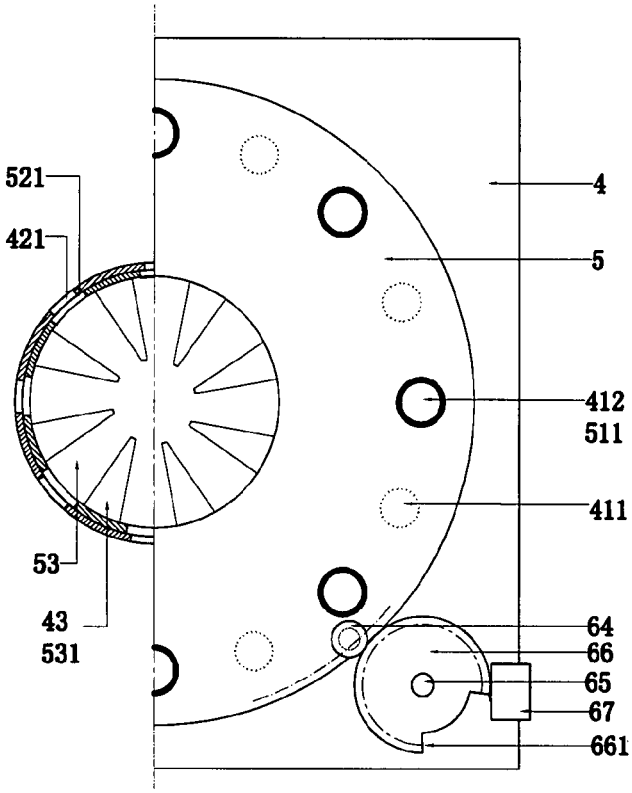
FIG. 7 is the top view of the half cross section of the rotating disc seat, rotating disc and the driving unit therefor in the mode of blowing trash.
Figure 8:
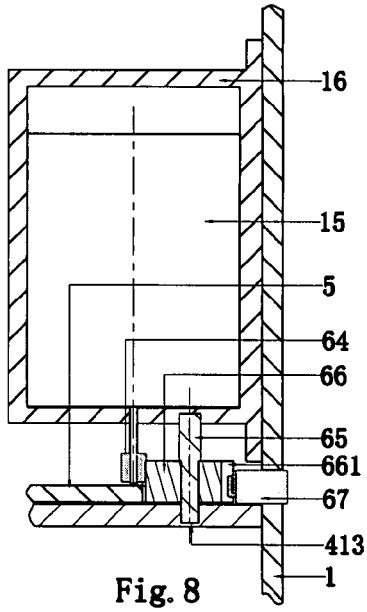
FIG. 8 is a schematic diagram of the structure of an automatic rotating disc driving unit of the present invention.

As shown in FIG. 7 and FIG. 8, electrically operated rotating disc driving unit comprises a driving gear 64, a link 65, a change gear 66 connected to the lower portion of the link and engagement teeth which are arranged on part of the outer portion of the rotating disc 5. The gear 64 is engaged with change gear 66. The lower portion of the link 65 is inserted and positioned in the change shaft hole 413. A slot 661 is formed on the outer edge of the change gear 66, a change switch 67 is arranged at the edge of outer portion of change gear 66, a contact of the change switch 67 is positioned in the slot 661 when extends out but contacts the change gear 66 under pressure when withdrawn. If a step motor or a servo motor is applied to drive the rotating disc, the change switch and the slot may not be provided. The driving gear 64 on the motor shaft may be directly used to drive the engagement teeth which are arranged on part of the outer portion of the rotating disc. Of course, the worm shown in FIG. 32 may also be directly used to drive the engagement teeth which are arranged on part of the outer portion of the rotating disc.

The rotating disc 5 is circular. The circumferences of the outer shell 1, inner shell 2 and rotating disc seat 4 are rectangular. Of course, the aforesaid components may be in other shapes, such as the circumferences of the outer shell 1, inner shell 2 and rotating disc seat 4 may be circular and the windows may also be in various shapes and the quantity thereof can be flexible.

Figure 9:
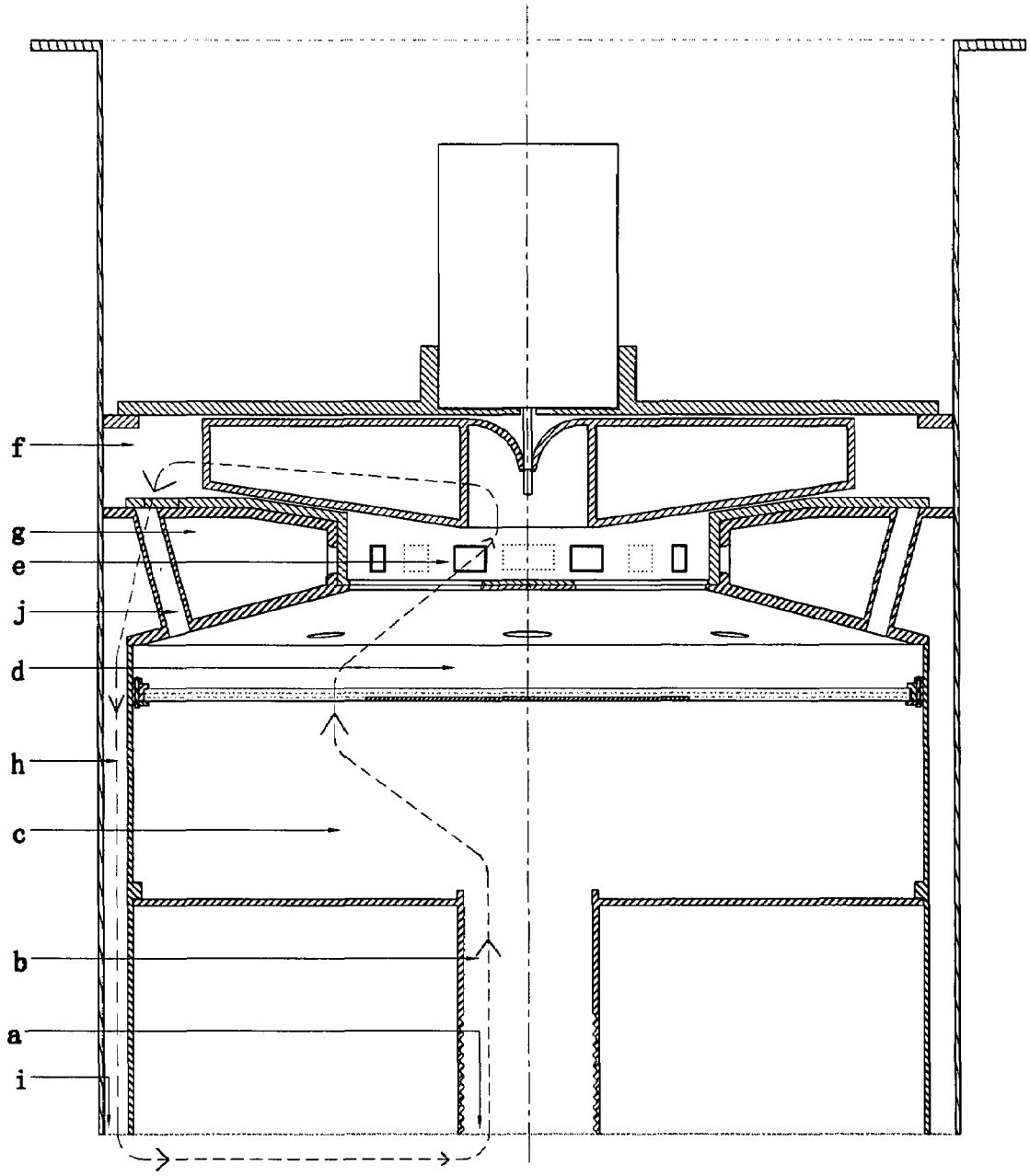
FIG. 9 is the air flow path in the mode for collecting trash of one embodiment having only an impeller but no fan of the present invention.
Figure 10:
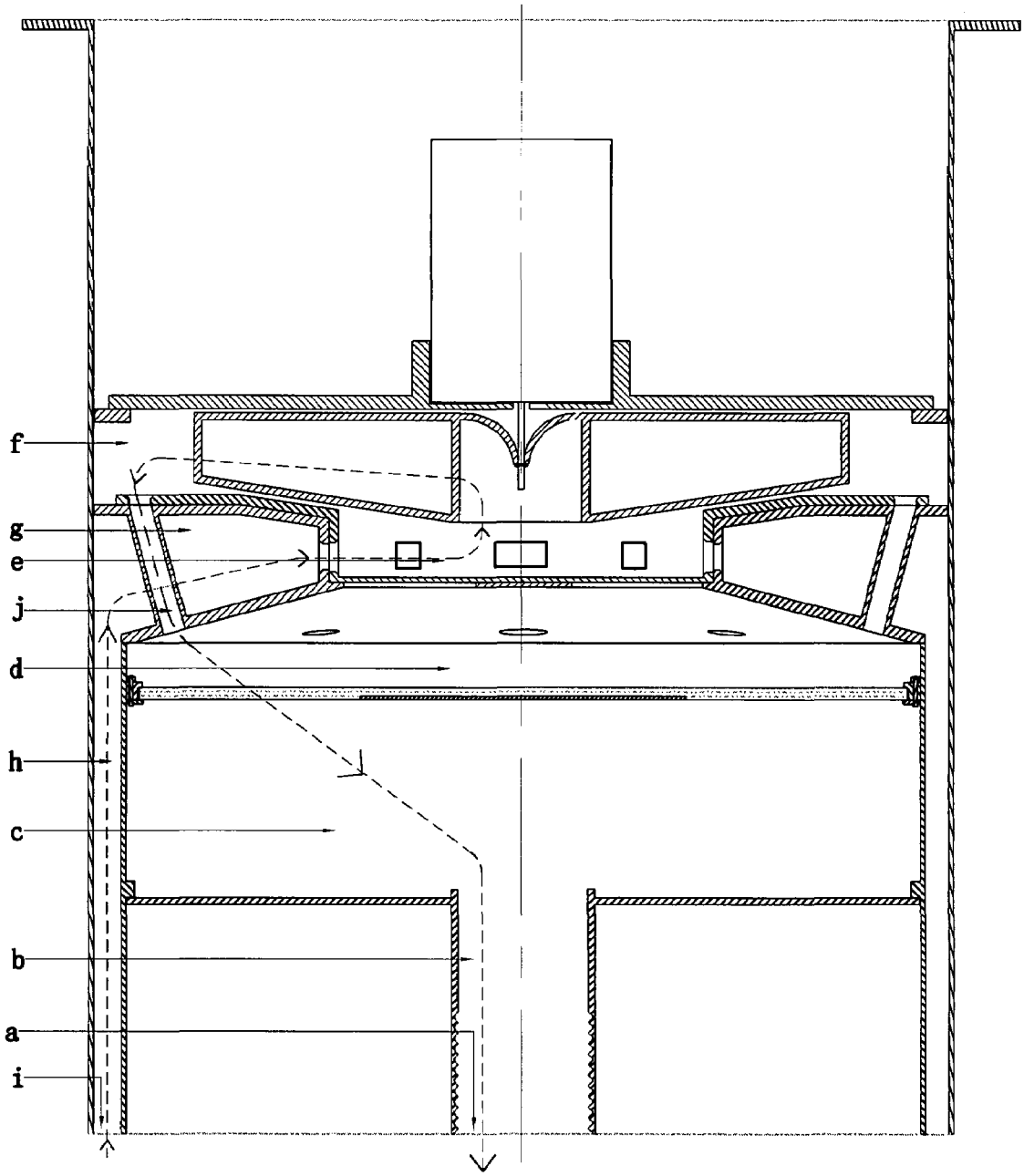
FIG. 10 is the air flow path in the mode for blowing trash of one embodiment having only an impeller but no fan of the present invention.

As shown in FIG. 9, when the upper windows located in the upper portion of the rotating disc are rotated to the positions such that said upper windows are aligned with the upper windows of the rotating disc seat, the air inlet windows located on the upper flange of the rotating disc seat are covered by other parts of the upper portion other than the upper windows of the rotating disc, the middle windows of the rotating disc are covered by other portions of the rotating disc seat other than the middle windows thereof, the middle windows of the rotating disc seat are covered by other portions of the rotating disc other than the middle windows thereof, the lower windows of the rotating disc are aligned with the lower windows in the partition which is located in the middle of the rotating disc seat and thereby the air can be induced into the trash chamber c from the air inlet a of the air inlet duct 11 which is inserted and positioned in the partition located in the lower part of the inner chamber of the inner shell through the air inlet tunnel b, the trash is left in the trash chamber but the air goes through the filter 9 into the lower chamber d. The air enters the upper chamber e through the lower windows of the rotating disc seat and the lower windows of the rotating disc and is then forced into the change tunnel f by the impeller 7 and flows through the upper windows of the rotating disc and the upper windows of the rotating disc seat and enters the middle chamber g. Then the air is discharged from the air outlet of the cleaner through the tunnel h which is formed between the inner wall of the outer shell and the outer wall of the inner shell. This is the mode for collecting trash. The flow path of the air is a-b-c-d-e-f-g-h-i.

As shown in FIG. 9, when the upper windows located in the upper portion of the rotating disc are rotated to the positions such that said upper windows are aligned with the air inlets located in the upper flange of the rotating disc seat, the upper windows of the upper flange of the rotating disc seat are covered by other parts of the upper portion of the rotating disc other than the upper windows thereof, the middle windows of the rotating disc are aligned with the middle windows of the rotating disc seat, the lower windows of the rotating disc are covered by other portions of the partition which is in the middle of the shell body of the rotating disc seat other than the lower windows located in the partition, the lower windows located in the partition are covered by other portions of the bottom portion of the rotating disc other than the lower windows thereof and thereby the air is induced into the middle chamber g from the air outlet through the tunnel h which is formed between the inner wall of the outer shell and the outer wall of the inner shell and enters the upper chamber e through the middle windows of the rotating disc seat and the middle windows of the rotating disc, then is forced into the change tunnel f by the impeller 7, enters the return air tunnel j through the upper windows of the rotating disc and the air inlets of the rotating disc seat, next, the air flows into the lower chamber d through the air outlets of the rotating disc seat and enters the trash chamber c through the filter 9, then takes the trash and flows through the air inlet tunnel b and finally the trash is blown out from the air inlet al. This is the mode for blowing trash. Under this mode, the flow path of the air is i-h-g-c-f-j-d-c-b-a.

Figure 11:
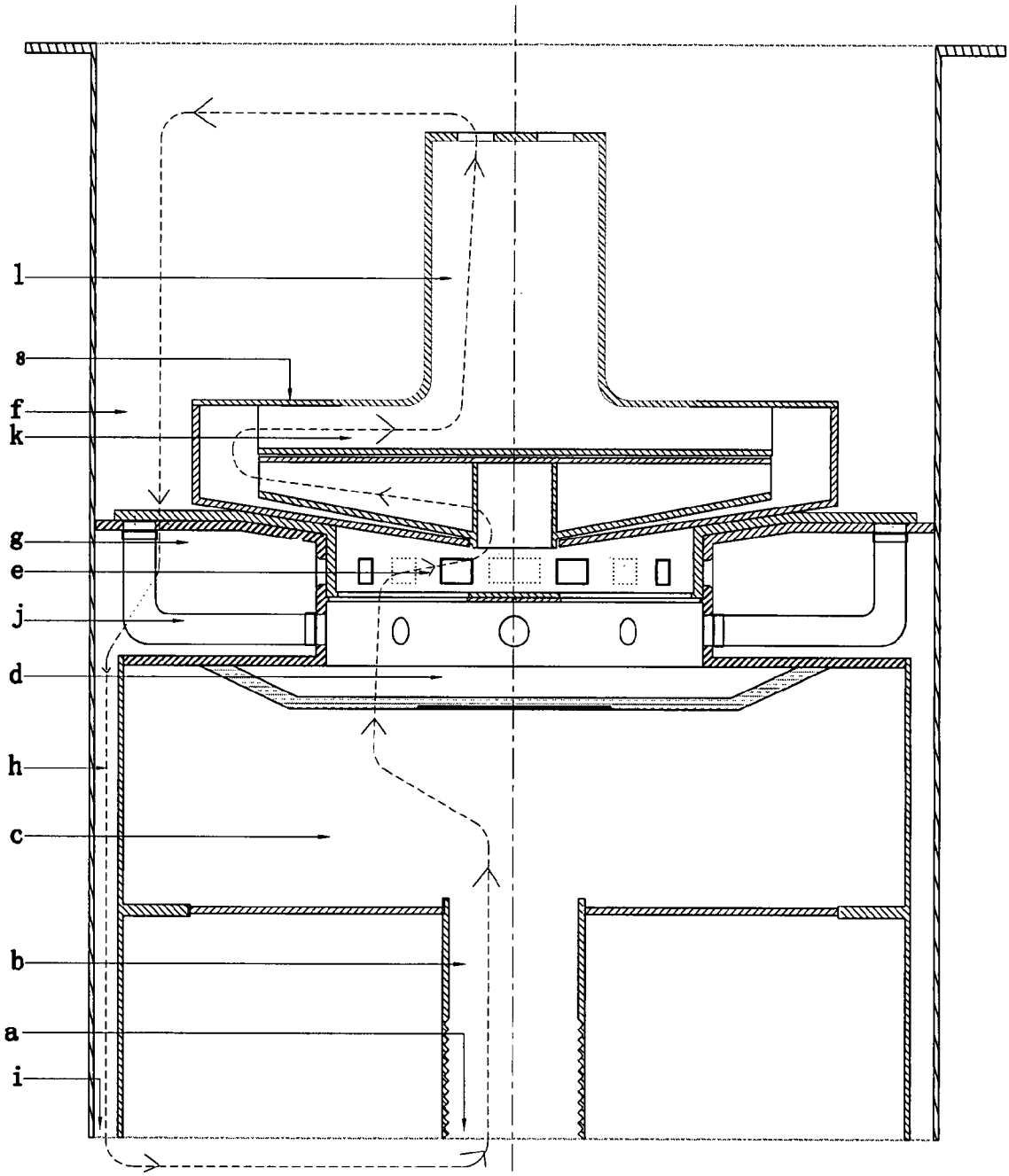
FIG. 11 is the air flow path in the mode for collecting trash of one embodiment having a fan of the present invention.
Figure 12:
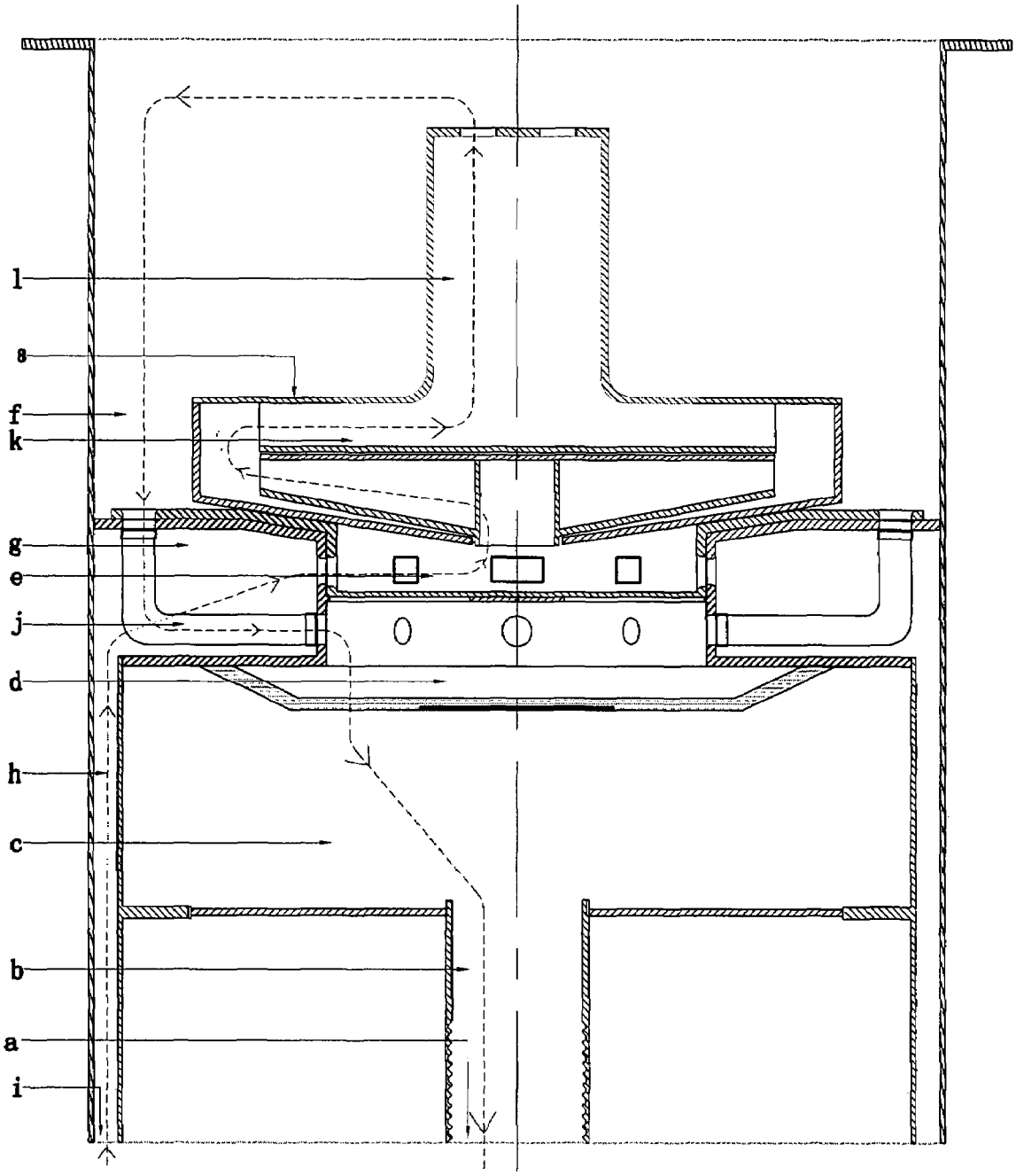
FIG. 12 is the air flow path in the mode for blowing trash of one embodiment having a fan of the present invention.
Figure 13:
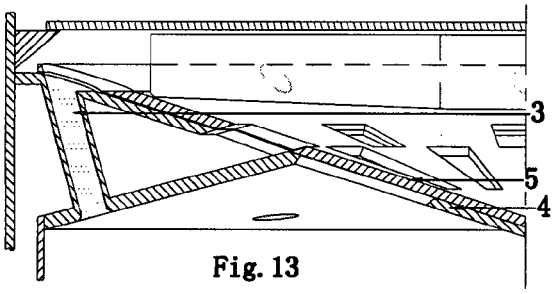
FIGS. 13-20 are cutaway views of several embodiments of the present invention.
Figure 14:
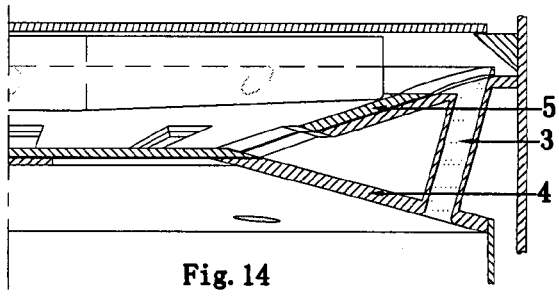

As shown in FIG. 11 and FIG. 12, the cleaner has a fan 8. In this case, the air is forced into fan chamber k by impeller 7 from the upper chamber e and enters the change tunnel.

As indicated in FIG. 11, the flow path of the air under the mode of collecting trash is a-b-c-d-e-k-l-f-g-h-i.

As indicated in FIG. 12, the flow path of the air under the mode of blowing trash is i-h-g-c-k-f-j-d-c-b-a.

Figure 15:
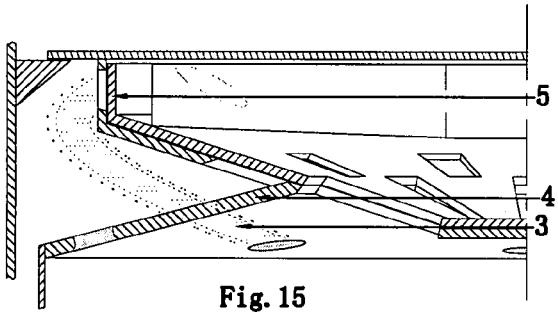
Figure 16:
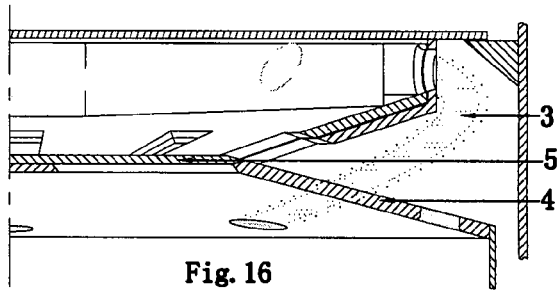
Figure 17:
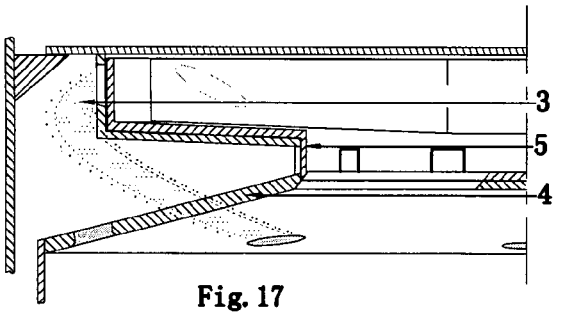
Figure 18:
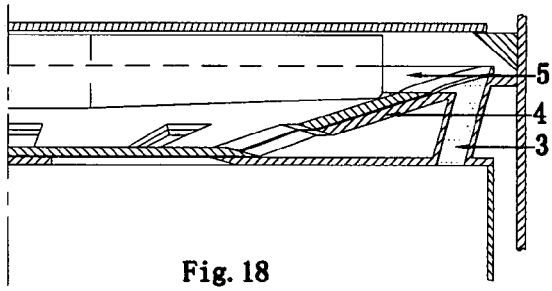
Figure 19:
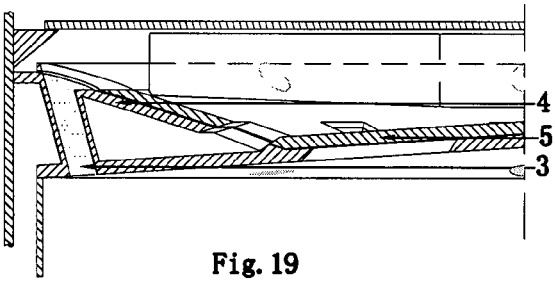
Figure 20:
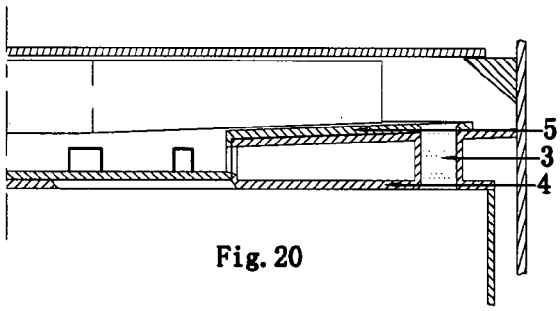

FIG. 13 to FIG. 20 show partial cross-section views of several configurations of the present invention (wherein FIG. 15 and FIG. 17 are cross-section views under the mode of collecting trash whereas others are cross-section views for blowing trash). In addition, combinations of parts of aforesaid different configurations may also be used in this invention. In case that the return air duct is in a shape of spirality, as shown in FIG. 15-17, the direction of the spiral of the return air duct shall be in conformity to the direction of the spiral of the impeller. Generally, the return air duct may be molded integral with the rotating disc seat or attached thereto. The way for attaching the return air duct to the rotating disc seat can be a treaded connection, muffcoupling or a sticking by using a sealant. Secondary sealing materials may also be arranged between the rotating disc and rotating disc seat. In case that only impeller 7 is applied, it is required that the gap between the impeller and the rotating disc is arranged as small as possible to reduce the air leakage.

Figure 21:
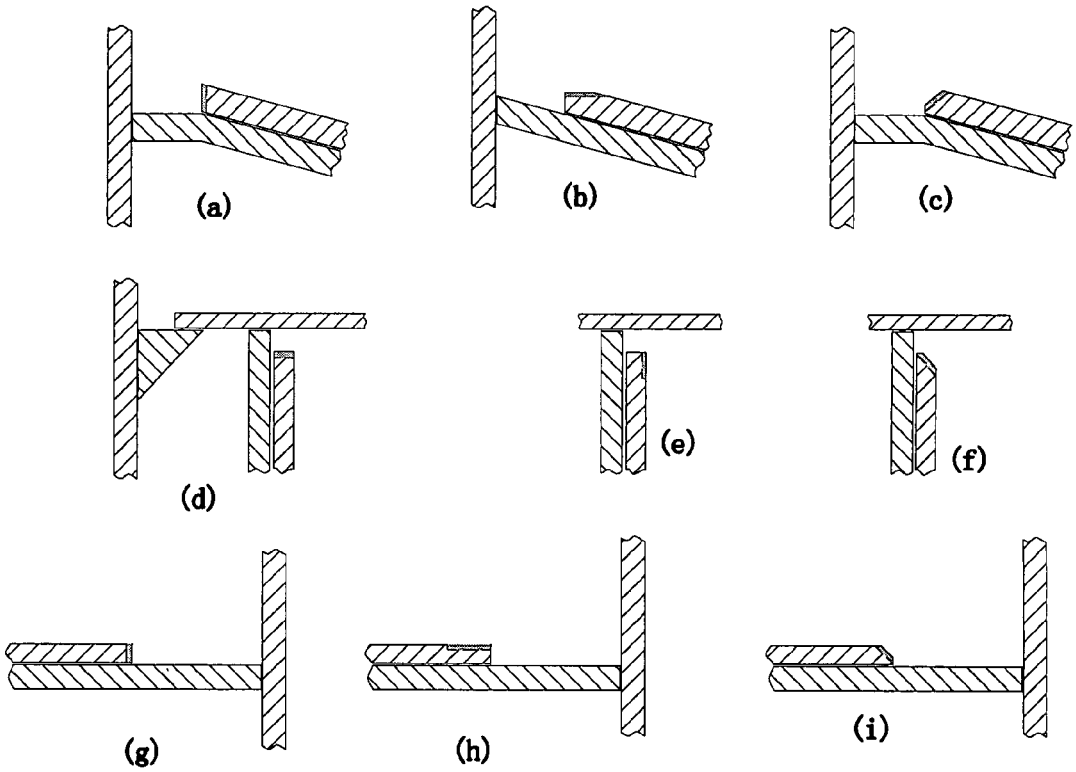
FIGS. 21 (*a*)-(*i*) are the schematic diagrams of the locations of the gear (the shaded portions on the drawings) on several embodiments of the rotating disc of the present invention.

FIG. 21 (*a*)-(*i*) are the schematic diagrams of positions of the gears (shadow parts in the figures) located on the rotating disc in several embodiments of the present invention. The handle of the switch of the rotating disc may be located on the top or on the outer shell of the cleaner. The change gear of the rotating disc may be driven by the handle located on the top of the cleaner, or by the handle located on the outside shell of the cleaner, which depends on the engaging location of the gear and the rotating disc. The change gear of the rotating disc may be a bevel gear and change the handle to another direction via another bevel gear. If required, the gear located on the rotating disc can be designed as conical inserts. As shown in FIG. 21 (*c, f, j*), the gear located on the rotating disc may also be designed as a gear which can be driven by a worm.

It is understood that the cleaner of this invention has a big problem, i.e., the cooling of the motor. This problem can be solved by using a heat-resistant motor, an air inlet or air outlet provided on the outside shell of the motor chamber, a separate cooling fan or another impeller which is fixed on the other end of the rotating axis of the motor. As for a cleaning robot, ventilation windows may be provided on the outside shell of the motor so as to cool the motor by the convective air when the robot moves, or a program controlled temperature sensor may be installed adjacent to the motor so as to stop the motor a certain period of time for cooling when the temperature of the motor rises to a predetermined level. In the accompanying drawings, the air inlet is arranged at the center of the bottom of the cleaner. Of course, the air inlet may also be arranged at other locations, such as the air inlet may be arranged on the four sides or four corners of the bottom of the cleaner via changing the ventilation path inside the cleaner and arranging the air discharge at the central of the bottom of the cleaner. As a cleaner which an extended tube is used, the extended tube may be designed as a dual-tube. A minor variation of this invention may be made by providing windows on the outside shell at the locations of the middle chamber to discharge the air which flows through the motor directly from the cleaner. The "blow trash" may also be achieved through changing the air flow by using the rotating disc only instead of the "return air blow" in this invention.

Figure 22:
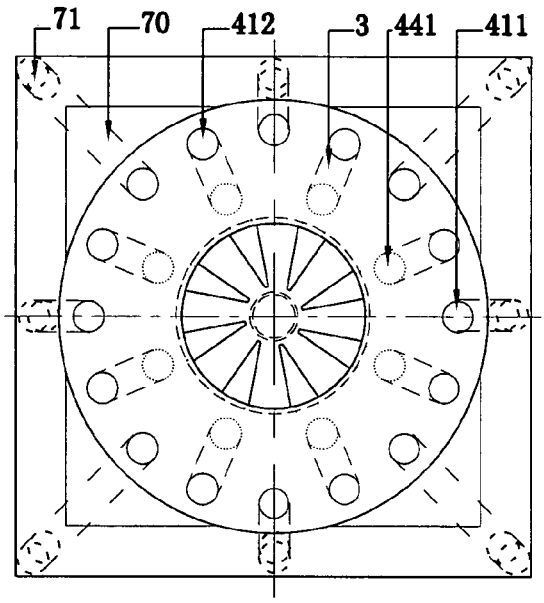
FIGS. 22-23 are top perspective views of two embodiments of rotating disc seat including return air ducts and air discharge ducts, wherein the windows located on the diagonal lines are the upper windows of the rotating disc seat in FIG. 22 and the windows located on the diagonal lines are the upper air inlets of the rotating disc seat in FIG. 23.
Figure 23:
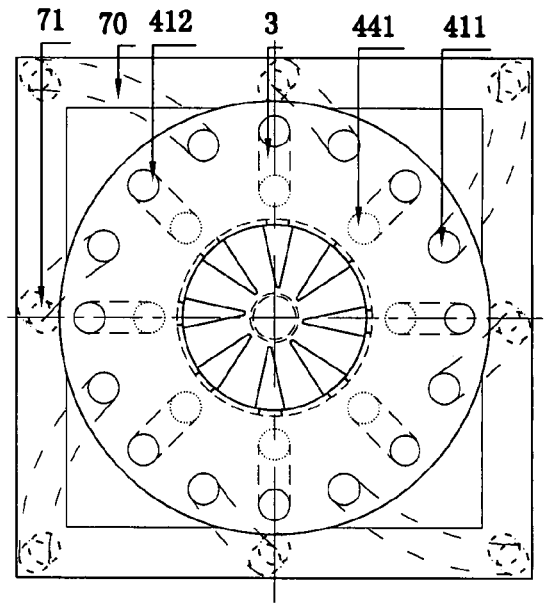
Figure 24:
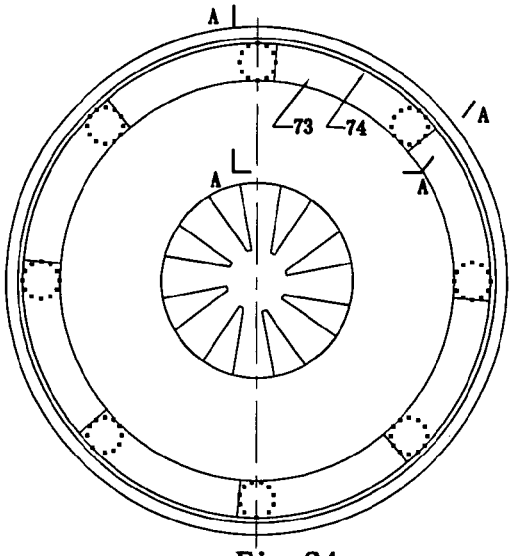
FIGS. 24-25 are top views of two embodiments of the rotating disc having a volute, wherein the rotating disc shown in FIG. 24 can be used when the impeller induces air ahead at the center and discharges air ahead (reversible type) at the edges thereof; the rotating disc shown in FIG. 25 can be used when the impeller induces air ahead at the center and discharges air outward (centrifugal type) at the edges thereof.
Figure 25:
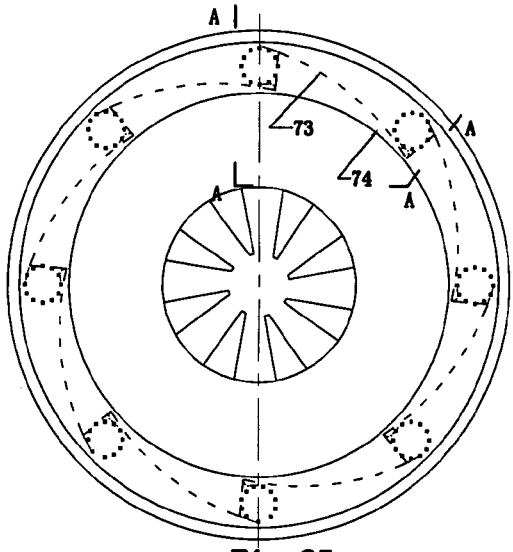
Figure 26:
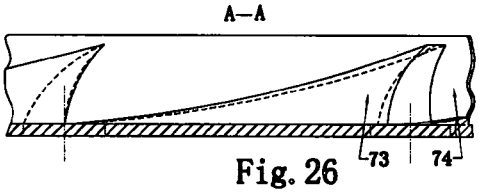
FIG. 26 is partial cross section view of the volute of the rotating disc shown in FIG. 24.
Figure 27:
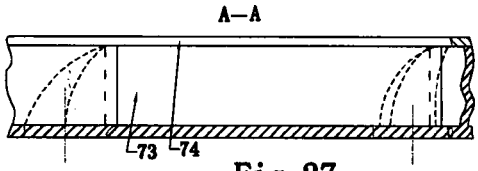
FIG. 27 is a partial cross section view of the volute of the rotating disc shown in FIG. 25.
Figure 28:
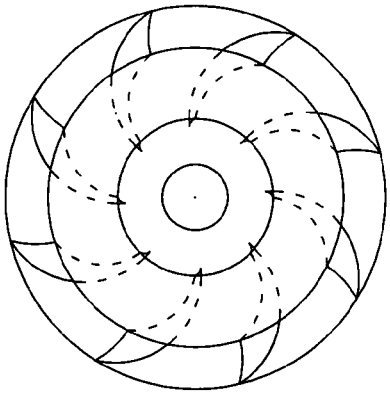
FIGS. 28-31 are schematic diagrams of several embodiments of the blades of the impeller of the present invention.
Figure 29:
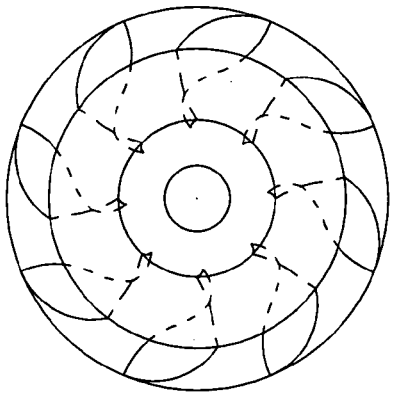
Figure 30:
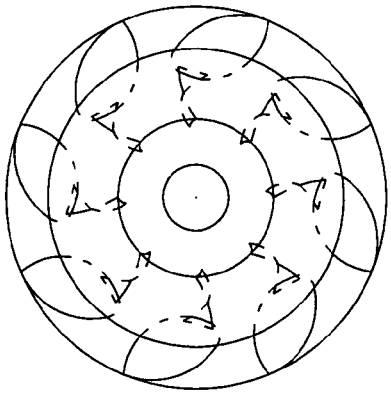
Figure 31:
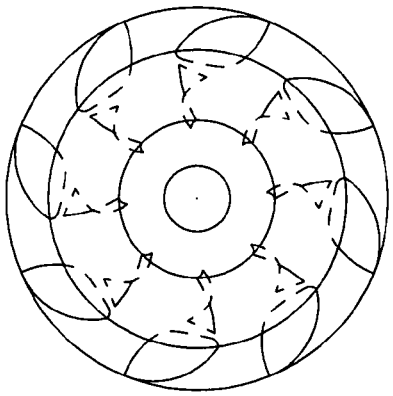
Figure 32:
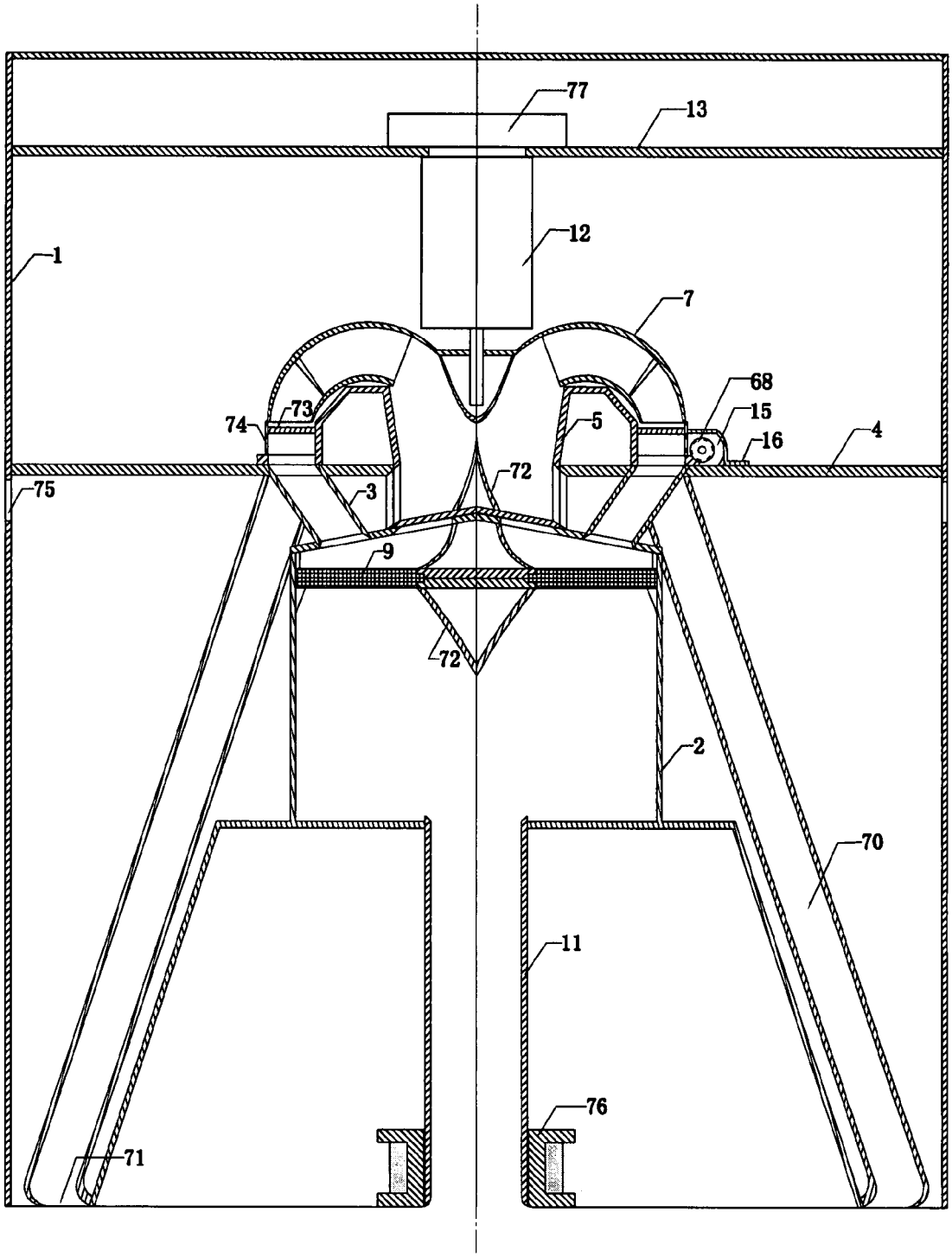
FIG. 32 is a partial cross section view of the inner structure of a vacuum cleaner of the present invention.

The present invention provides an inner structure for a cleaner or cleaning robot based on the theory. The invention may be further optimized in light of the theory of air mechanics and common knowledge of air exhaustion and dust removal to reduce the resistance in the air tunnels or shells. As shown in FIGS. 22-23, FIG. 32, an air exhaust tunnel 70 may be arranged in the tunnel between the outer shell and the inner shell. The two ends of the air exhaust tunnel are the upper windows 411 of the rotating disc seat and air discharge 71. A group of side windows 75 may also be arranged on the wall of the outer shell at the portions of the middle chamber. When the trash needs to be discharged, the air enters the middle chamber from the side windows 75 and flows to the upper chamber through the middle windows of the rotating disc and the middle windows of the rotating disc seat. The side windows 75 of the outer shell may also be connected to the middle windows of the rotating disc seat by a duct. All the ducts are designed circular and the ends thereof may be designed gradually enlarging or gradually tapering. All the bends of the shells should be designed arc and the radius thereof should be as large as possible. The diameter of the shells should also be as large as possible and the surfaces of the shell should be smooth for easy air flow. Streamline air deflector may be arranged at the locations where the air flow joins or separates, such as the central portions of the upper side and bottom side of the filter, lower side of the center of the rotating disc seat, upper side of the center of the rotating disc, the change tunnel side just facing the upper windows of the rotating disc. Each window may also be designed gradually enlarging or gradually tapering, or even more complicated such as a volute which is similar with the spiral volute of a cleaner may be arranged on the rotating disc, as shown in FIGS. 24-25. The direction of air discharging just faces the upper windows 511 of the rotating disc other than the motor of a conventional cleaner. Furthermore, the shape of the discharging windows is in conformity with the upper windows of the rotating disc. The joint portion of the volute and the upper windows of the rotating disc present a streamline transition. The type of the volute is typically a log spiral and the volute can be rotated along with the rotating disc 5. The segments of the volute are in conformity with said windows. The baffler 73, separating plate 74 may be molded integral with the rotating disc or secured separately. In addition, the air expelled by the impeller is not discharged directly out of the cleaner and the kinetic energy needed by the air flow at the outlet of the impeller is much higher than that of a conventional cleaner. Therefore, a forward-inclined narrow impeller may be used; the surface of the impeller may be a taper or an arc and of course better a shape coming from calculation and test. A radial type even a backward-inclined impeller which is of higher efficiency but low pressure may also be considered. Common means for improving the efficiency of an impeller may also be used to improve the performance thereof and the impeller may be designed more complicated to obtain an impeller at the center of which the air enters ahead and at the edges of which the air exits ahead. As shown in FIG. 32, the air path inside the impeller is changed somewhat and the direction of exiting air just faces the upper windows of the rotating disc. The inner blades of the said impeller are centrifugal type and the outer blades thereof are axial flow type. Between the inner blades and the outer blades, there exists a cavity, or the inner blades and the outer blades are partially overlapped with each other and have a gap at the overlapped part, or the inner blades and the outer blades are connected with each other and transit smoothly to a single 1.

Since the trash is discharged from the cleaner by blowing the filter from the reverse side in this invention, the filter in this invention is preferably made of woven filtering materials, punched felt filtering materials or glass fiber filtering materials which are easy to remove the dust therefrom.

Although the present invention is directed to a cleaner, the configurations in this invention can also be applied to industrial filtering and/or dust removal applications, particularly the industrial dust removal applications through blowing the filter from the reverse said.

Figure 33:
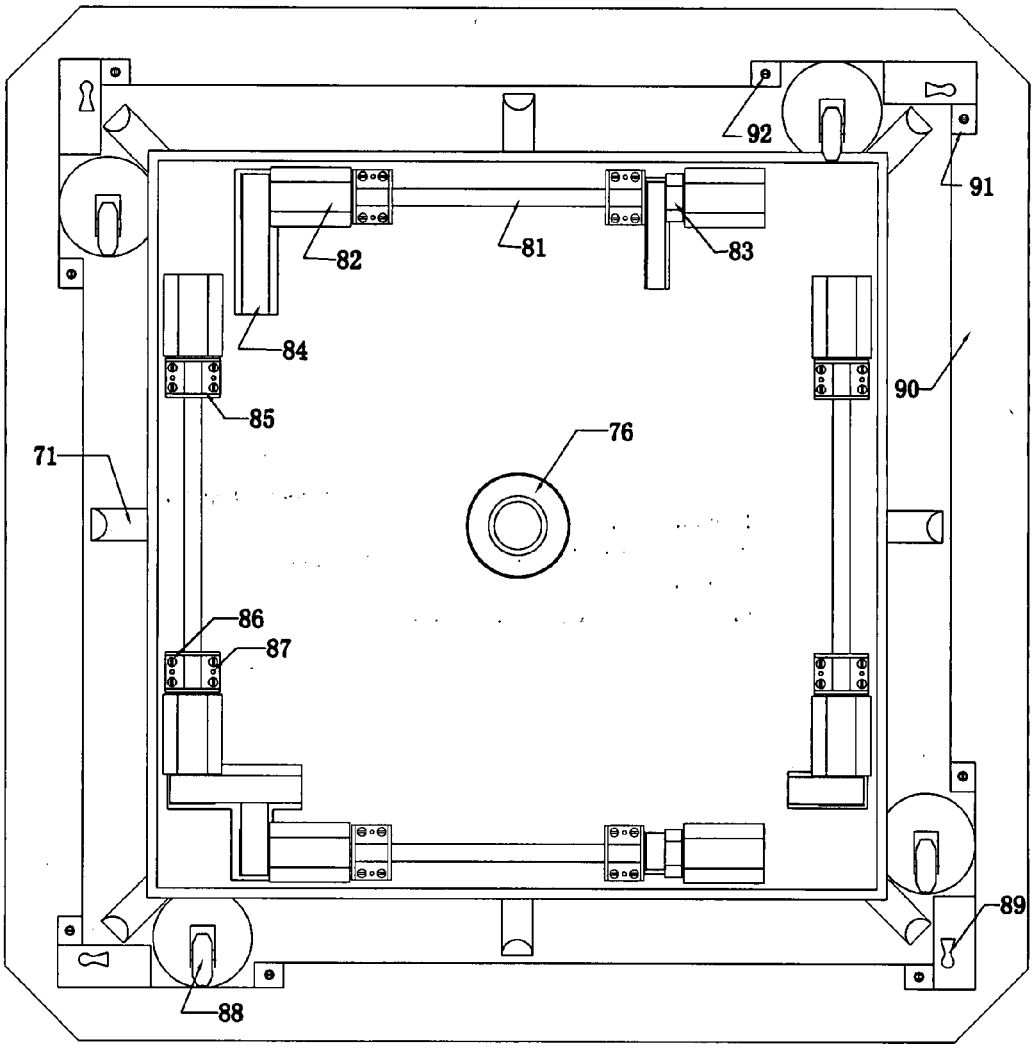
FIG. 33 is the schematic diagram of the bottom of a vacuum cleaner in the present invention.

The walking structure of the cleaner in this invention may use the walking structure described in the specification of international application PCT/CN2004/000187. As shown in FIG. 33, axles 81 of the wheels are arranged in a rectangular shape and secured onto the bottom panel of the walking structure through wheel support 85. Hexagon wheels are arranged on the axles of the wheels and driven by a synchronous belt. One or a pair of non-circular or circular eccentric wheels 83 (a pair of wheels refer to the front wheel plus rear wheel or the left wheel plus the right wheel) which are slightly smaller than the walking wheels 82 are blankly held onto one or a pair of axles of wheels. Wheels 83 may be driven by a synchronous belt and rotated separately on the axle to achieve correcting and turning. The walking structure is not fixed to the main body of the cleaning robot but blankly held therein. The main body of the cleaning robot is supported by four or even more universal wheels 88 and pushed ahead, back, left and right as required. At the corners of the bottom of the robot, photoelectric shift sensors are fixed thereto to measure the distances the robot moves. Said photoelectric shift sensor may be the sensor chip of a photoelectric mouse or a set of sensors thereof. A contact-type sensor which is described by Chinese patent application CN 200410014461.0 wraps the outside shell of the robot. Similar contact-type fall sensors may also be fixed downward to the edge of the bottom of the robot. Said sensor comprises a membrane sensor switch and a center-caved sponge covered thereon to which surface a layer of antifriction material attaches. The switch is normally closed because the sponge is pressed due to contact pressure from the ground but will be released in case the robot hangs in the air and so detects any possible falls such as stairs.

EXPLANATIONS TO OTHER REFERENCE NUMBERS

12—motor; 13—motor support; 14—isolation pad for switch handle of the rotating disc; 15—change motor for rotating disc; 16—change motor support for rotating disc; 17—restriction frame for filter support, rotatable restriction pins arranged on the frame to remove the filter support when said all pins are rotated to a certain direction whereas lock the filter support when said pins are rotated to other directions; 18—air permeable filter; 19—upper filter support; 20—lower filter support, in the center of which is a substantially solid disk; 76—electromagnet, which is used to attract the trash tunnel to the trash chamber when the trash needs to be discharged; 77—cooling fan, which is solely used to cool the motor 12 down; 86—screws, which are used to secure the wheel support 85; 87—locating hole of wheel support 85; 92—screws, which are used to secure the fall sensors 91.

The definitions or terms referred to in this description are relative and directed to a cleaner with an "up-down" structure ("up-down" refers to the relationship of the locations of the trash chamber and motor). As for a cleaner with a "left-right" structure, the structure described as above also applies except the definitions or terms may be different. In other words, when the "up-down" structure is turned by 90°, it can be used in a cleaner with a "left-right" structure.

What is claimed is:

1. An air reflux assembly for a cleaner, comprising: an outer shell with an inner chamber, an inner shell, a rotating disc, a rotating disc seat, and return air ducts the inner shell is positioned at a lower part of the inner chamber of the outer shell, the rotating disc seat is connected to an upper portion of the inner shell, the rotating disc is placed against the rotating disc seat; said rotating disc seat comprises an upper flange, a body with an inner chamber, a partition and a lower flange; a first three groups of upper windows, middle windows, lower windows are arranged in the rotating disc seat and the upper windows are arranged in the upper flange, the middle windows are arranged in the body and the lower windows are arranged in the partition; upper air inlets and lower air outlets are arranged on the rotating disc seat, the upper air inlets are arranged in the upper flange, the lower air outlets are arranged under the middle windows; the two ends of the return air duct are respectively connected to the upper air inlets and the lower air outlets; a second three groups of upper windows, middle windows, lower windows which correspond to the first three groups of upper windows, middle windows, lower windows of the rotating disc seat are arranged in the rotating disc; the bottom surface of the rotating disc is in conformity with the top surface of the rotating disc seat; when the upper windows of the rotating disc are rotated to the positions where said upper windows are aligned with the upper windows of the rotating disc seat, the upper air inlets of the rotating disc seat are covered by other portions of the rotating disc other than the upper windows, the middle windows of the rotating disc are covered by other portions of the rotating disc seat other than the middle windows, the middle windows of the rotating disc seat are covered by other portions of the rotating disc other than the middle window, the lower windows of the rotating disc are aligned with the lower windows of the rotating disc seat; when the upper windows of the rotating disc are rotated to the positions where said upper windows are aligned with the upper air inlets of the rotating disc seat, the upper windows of the rotating disc seat are covered by other portions of the rotating disc other than the upper windows, the middle windows of the rotating disc are aligned with the middle windows of the rotating disc seat, the lower windows of the rotating disc are covered by other portions of the rotating disc seat other than the lower windows, the lower windows of the rotating disc seat are covered by other portions of the rotating disc other than the lower windows.

2. The air reflux assembly for a cleaner according to claim 1, wherein the partition is arranged in the inner chamber of the body, and wherein the lower air outlets are arranged in the body under the partition.

3. The air reflux assembly for a cleaner according to claim 1, wherein the partition is arranged on the bottom of the body, and wherein the lower air outlets are arranged in the lower flange of the rotating disc seat.

4. The air reflux assembly for a cleaner according to claim 1, further comprising a rotating disc driving unit, said rotating disc driving unit comprises a handle, a change gear connected to a lower portion of the handle and engagement teeth arranged on part of outer portions of the rotating disc; the lower portion of the handle is inserted and positioned in a change shaft hole of the rotating disc seat.

5. The air reflux assembly for a cleaner according to claim 2, further comprising a rotating disc driving unit, said rotating disc driving unit comprises a handle, a change gear connected to a lower portion of the handle and engagement teeth arranged on part of outer portions of rotating disc; the lower portion of the handle is inserted and positioned in a change shaft hole of the rotating disc seat.

6. The air reflux assembly for a cleaner according to claim 3, further comprising a rotating disc driving unit, said rotating disc driving unit comprises a handle, a change gear connected to a lower portion of the handle and engagement teeth arranged on part of outer portions of rotating disc; the lower portion of the handle is inserted and positioned in a change shaft hole of the rotating disc seat.

7. The air reflux assembly according to claim 4, wherein a slot is formed on an outer edge of the change gear, and a lock pin corresponding thereto is arranged on the rotating disc seat.

8. The air reflux assembly according to claim 5, wherein a slot is formed on an outer edge of the change gear and a lock pin corresponding thereto is arranged on the rotating disc seat.

9. The air reflux assembly according to claim 6, wherein a slot is formed on an outer edge of the change gear and a lock pin corresponding thereto is arranged on the rotating disc seat.

10. The air reflux assembly for a cleaner according to claim 1, further comprising a rotating disc driving unit, said rotating disc driving unit comprises a driving gear, a link, a change gear connected to a lower portion of the link and engagement teeth arranged on part of outer portions of the rotating disc, the driving gear is engaged with the change gear; the lower portion of the link is inserted and positioned in a change shaft hole of the rotating disc seat.

11. The air reflux assembly for a cleaner according to claim 2, further comprising a rotating disc driving unit, said rotating disc driving unit comprises a driving gear, a link, a change gear connected to a lower portion of the link and engagement teeth arranged on part of outer portions of the rotating disc, the driving gear is engaged with the change gear; the lower portion of the link is inserted and positioned in a change shaft hole of the rotating disc seat.

12. The air reflux assembly for a cleaner according to claim 3, further comprising a rotating disc driving unit, said rotating disc driving unit comprises a driving gear, a link, a change gear connected to a lower portion of the link and engagement teeth arranged on part of outer portions of the rotating disc, the driving gear is engaged with the change gear; the lower portion of the link is inserted and positioned in a change shaft hole of the rotating disc seat.

13. The air reflux assembly for a cleaner according to claim 10, wherein a slot is formed on an outer edge of the change gear, a change switch is arranged at the outer edge of the change gear, a contact of the change switch is positioned in the slot when extending out but contacts the change gear under pressure when it is withdrawn.

14. The air reflux assembly for a cleaner according to claim 11, wherein a slot is formed on an outer edge of the change gear, a change switch is arranged at the outer edge of the change gear, a contact of the change switch is positioned in the slot when extending out but contacts the change gear under pressure when it is withdrawn.

15. The air reflux assembly for a cleaner according to claim 12, wherein a slot is formed on an outer edge of the change gear, a change switch is arranged at the outer edge of the change gear, a contact of the change switch is positioned in the slot when extending out but contacts the change gear under pressure when it is withdrawn.

* * * * *